US006379468B1

(12) United States Patent
Chang et al.

(10) Patent No.: US 6,379,468 B1
(45) Date of Patent: Apr. 30, 2002

(54) METHOD FOR CLEANING THIN METAL STRIP MATERIAL

(75) Inventors: Chen-Chung S. Chang, Attleboro; Bijendra Jha, North Attleboro; Wayne R. Bachand, New Bedford, all of MA (US); John J. Duprey, Lincoln, RI (US)

(73) Assignee: Engineered Materials Solutions, Inc., Attleboro, MA (US)

( * ) Notice: Subject to any disclaimer, the term of this patent is extended or adjusted under 35 U.S.C. 154(b) by 0 days.

(21) Appl. No.: 09/669,331

(22) Filed: Sep. 25, 2000

Related U.S. Application Data

(60) Provisional application No. 60/172,728, filed on Dec. 20, 1999.

(51) Int. Cl.[7] ..... B08B 3/04; B08B 1/02; B08B 7/04

(52) U.S. Cl. ..... 134/6; 134/9; 134/15; 134/26; 134/32; 15/102

(58) Field of Search ..... 134/6, 9, 15, 26, 134/32; 15/102, 77

(56) References Cited

U.S. PATENT DOCUMENTS 2,372,599 A * 3/1945 Nachtman ..... 134/9
4,458,376 A * 7/1984 Sitko ..... 15/256.5

* cited by examiner

*Primary Examiner*—Zeinab El-Arini
(74) *Attorney, Agent, or Firm*—Pearne & Gordon LLP

(57) ABSTRACT

A method for cleaning thin gauge metal foil strip material using a plurality of wiper (12, 16, 20) and solvent application (14, 18) stages. The solvent used in the solvent application stages is an aliphatic petroleum type which is applied using low pressure to avoid atomization or separation of solvent components. The wipers of a first wiping station are made of a solid bar of polymer impregnated fiber material. The wipers of the second wiping station are spaced apart blades of urethane-based elastomer material.

7 Claims, 3 Drawing Sheets

METHOD FOR CLEANING THIN METAL STRIP MATERIAL

This application claims priority under 35 USC Section 119 (e) (1) of provisional application No. 60/172,728 filed Dec. 20, 1999.

Field of the Invention

This application relates generally to the manufacture of metal foil material and more particularly to apparatus and methods for cleaning such material while in process or after completion of the manufacturing process.

BACKGROUND OF THE INVENTION

Cleaning of metal strips while in the manufacturing process or after the final cold finish is an indispensable operation in metal processing. The goal of cleaning is to remove contaminants from the strip surface with minimum damage to the strip and maximum throughput. Contaminants which can be removed from the surface of metals include oil, grease, waxy solids, metallic particles, dust, carbon particles and silica. Many factors need to be considered in developing and selecting a cleaning method including: (1) type of soil to be removed, (2) type of strip to be cleaned and the conditions of the surface or structure of the end use, (3) degree of cleanness required, (4) capability of the processes available, (5) environmental impact of the process, (6) overall cost of the process and (7) any subsequent processes to be applied.

Alkaline-based cleaning is a mainstay in the metal industry to remove surface contaminants and may employ both physical and chemical actions. Such processes have proven to be reliable and readily available from various equipment suppliers. However, for surface chemistry sensitive materials, the possibility of alkaline ions being left on the strip surface makes the use of alkaline based cleaning risky. For example, premature failure can occur when alkaline metal contaminated strips are exposed to elevated temperature. Other conventional cleaning processes such as vapor degreasing are not suitable either since environmental regulations are becoming ever more stringent.

Solvent cleaning, particularly cold cleaning using aliphatic petroleum based cleaning solvent, has an advantage over alkaline cleaning and vapor degreasing because of its non-toxic, environmental friendly nature. While conventional alkaline cleaning requires large quantity of water usage and disposal; solvents such as aliphatic petroleum based solutions, in general, carry significantly more contaminants than water. A significant advantage of solvent cleaning over the alkaline process is that less waste has to be disposed. Furthermore, used solvent can be recycled by treating with a scrubbing process such as vacuum assisted distillation or filtration to remove contaminants.

The cleaning of thin gauge materials usually requires the processing of long coil lengths. The line speed has to be maximized in order to obtain adequate throughput. Two process constraints limit the line speed of alkaline cleaning. The alkaline solution generally requires ½ to 3 minutes of dwell time to promote contaminant removal. Thus, in a high speed alkaline cleaning line, the length of the alkaline tank can become significant. The alkaline cleaning process uses water rinse at the end to remove the chemicals. The rinsed foil has to be dried to avoid staining of the foil surface. The drying of rinsing water requires either a slow line speed or a long drying section. These constraints pose several problems: (1) the need to reduce the line speed, (2) the need to increase the cleaning line length and (3) the need to complicate the design for thin gauge material handling.

SUMMARY OF THE INVENTION

An object of the invention is to provide a cleaning method and apparatus for metal strips which is effective to remove contaminants, is environmentally friendly and one which does not have harmful residuals. Another object of the invention is the provision of a cleaning method for thin gauge metal foils in which the apparatus used therewith is compact in size requiring less floor space than prior art procedures. Yet another object of the invention is the provision of a method and apparatus for cleaning metal strip material which minimizes space, has a fast line speed with less waste disposal than prior art methods and one which provides an improved cleansed strip surface.

Briefly, in accordance with the invention, a petroleum-based solvent is used as a cleaning agent. The solvent is sprayed onto the foil surface to remove a major portion of the contaminants. Multiple spraying chambers are used to provide a consistent cleaning result. Wipers sets, in opposing pairs, are used to remove the solvent and any remaining contaminants from the foil surfaces. The wiper sets (top and bottom) are incorporated by a coupled mechanism that applies an even, offsetting, pressure to the foil to avoid damaging the strip material. High or low pressure air blowers are used to remove any remaining solvent to achieve optimal cleanness. The solvent cleaning process according to the invention has the advantage of high line speed and compactness.

Although useful with various metal strips, the invention is particularly useful with metal foil material of the type disclosed in U.S. Pat. No. 5,980,658, assigned to the assignee of the present invention, the disclosure of which is included herein by this reference.

BRIEF DESCRIPTION OF THE DRAWINGS

Other objects, advantages and details of the novel cleaning method and apparatus of this invention appears in the detailed description of the preferred embodiment of the invention, the detailed description referring to the drawings in which.

DETAILED DESCRIPTION OF THE PREFERRED EMBODIMENT

Figure 1:
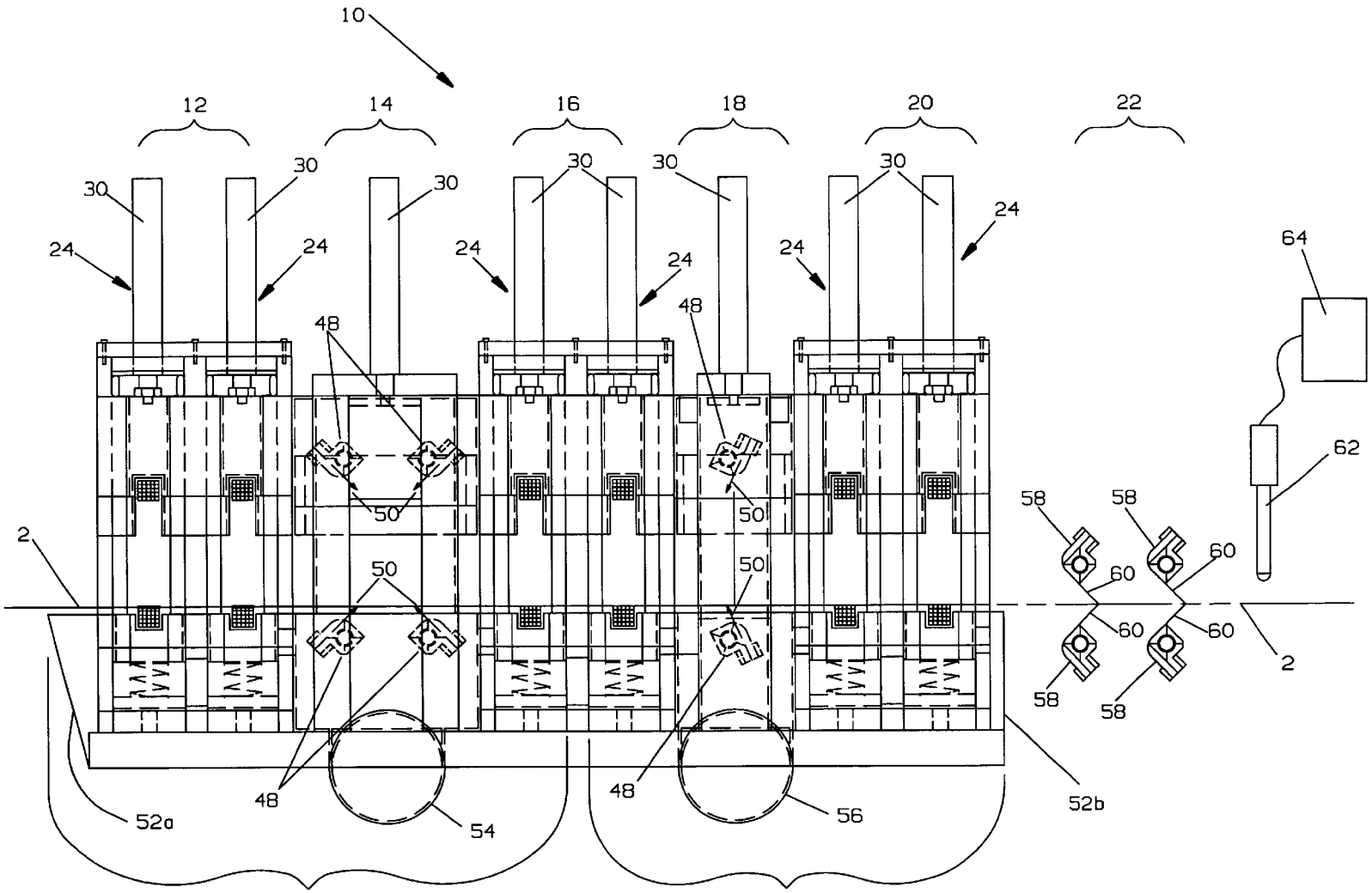
FIG. 1 is a schematic side elevational view of a metal foil cleaning line made in accordance with the invention.

With reference to FIG. 1, a metal foil strip material cleaning line 10 made in accordance with the invention comprises a first wiper stage 12, a first spray stage 14, an intermediate or second wiper stage 16, a second spray stage 18 and a finish or third wiper stage 20 followed by an air blower stage 22.

Figure 2:
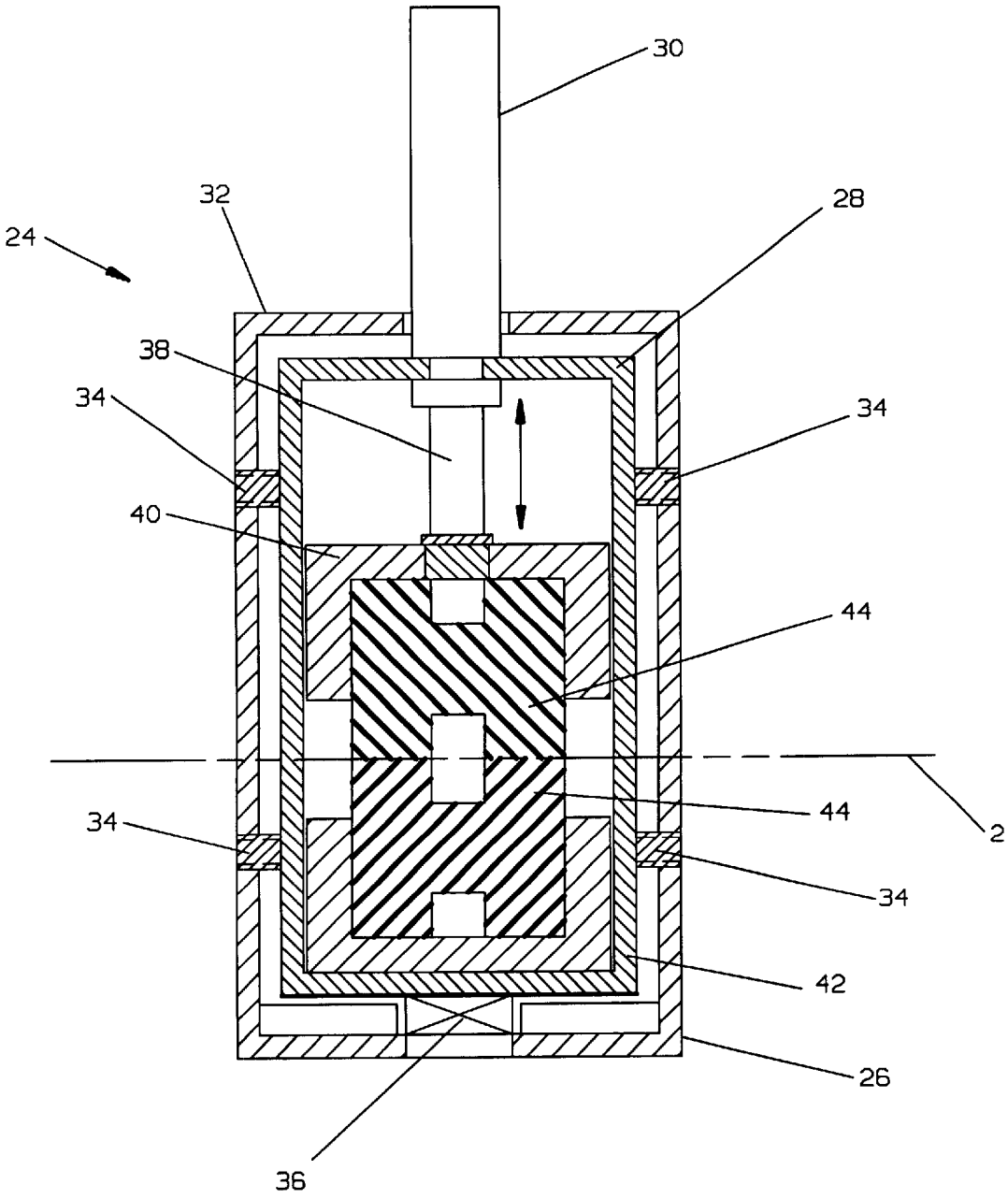
FIG. 2 is an enlarged cross sectional schematic view of a wiper used in the FIG. 1 embodiment.

The strip material to be cleaned is typically thin, for example, a layer of stainless steel 434 bonded to top and bottom aluminum layers having a bonded thickness, in an intermediate manufacturing stage, of between 0.0015 inch to 0.040 inch as well as a finished gauge as small as 0.001 inch. In order to avoid damaging the thin foil material, the invention employs wiper mechanisms in which wiping pressure is applied to opposite face surfaces of the foil simultaneously and in an even manner squeezing the foil. With reference to FIG. 2 which shows a cross sectional view of a wiper assembly 24, numeral 2 represents the pass line of the foil material. Wiper assembly 24 comprises an outer cage 26 formed of suitable material in which is contained a wiper box 28 formed of stainless steel or other suitable material which floats inside cage 26. The wiper box 28 is fixedly attached to air cylinder 30 at 32 by any suitable means such as by using a threaded nut or the like so that the wiper box and air cylinder float as a unit. Suitable guiding means are provided in cage 26 for wiper box 28 such as nylon tip screws 34 which cooperate with a compliant member 36 disposed at the bottom of the cage. Compliant member 36 permits even seating of the floating wiper box and is shown to be a spring but could also be selected foam material, a bladder, etc., as desired. Piston rod 38 is attached to the upper half of a generally U-shaped wiper holder 40 while a similar U-shaped holder 42 is disposed in the bottom of wiper box 28. As shown in FIG. 2, one form of wipers 44 particularly useful in stages 16 and 20 are generally H-shaped in configuration formed of suitable elastomer material providing a combination of properties including rigidity and minimization of contact area. Although the H-configured wipers 44 are preferred for stages 16 and 20, a solid bar of fibrous material has been found to be more practical at initial stage 12 for scrubbing and removing gross solid contaminants. Either type of wiper can be accommodated in holders 40, 42. It should also be noted that other wiper configurations can be employed, if desired. In order to provide a uniformly distributed load on wiper holder 40 it is preferred to employ a plurality of pneumatic cylinders. For example, in a cleaning line made in accordance with the invention which accommodates foil strips of up to approximately 24 inches in width, three laterally spaced cylinders at each wiper station were found to be satisfactory.

Turning back to FIG. 1, first wiper stage 12, which comprises two wiper stations 24 each preferably using wipers in the form of a solid bar of fibrous material, scrub the strip for removal of, as much as possible, gross solid contaminants. Suitable wiper material for stage 12 is a polymer impregnated fiber selected to provide extended longevity. Following stage 12, a solvent spray stage 14, comprising two pairs of opposing upper and lower spray heads 48, apply solvent to opposing face surfaces of the strip for rinsing off solid and liquid contaminants. The upper spray heads are moved into position by pneumatic means indicated at 30. Suitable cleaning solvents of the aliphatic petroleum type comprise multiple components and in order to prevent separation of the components, a lower pressure, i.e., less than approximately 100 psi, non-atomized, linear spray pattern is used, in contradistinction to conventional high pressure spray nozzles. The solvent is applied essentially as a laminar sheet of liquid to the surfaces of the strip. The second, or downstream pair of spray heads are oriented so that the liquid flow, as noted by arrows 50, is in a direction opposed to the direction of liquid flow in the upstream pair of spray heads which helps to contain the liquid within the area of spray stage 14 and away from second stage wiper stage 16. A tub 52 is positioned below the cleaning line and is separated to form separate compartments 52*a*, 52*b* for the first and second spray stages 14,18. Spray stage 14 is provided with a drainage duct 54 while spray stage 18, to be discussed, is provided with a drainage duct 56.

Wiper stage 16 serves to prevent contaminated solvent from being carried over to the subsequent cleaning stage 18 which applies liquid solvent, again using low pressure, from a separate solvent tank (not shown) to facilitate further contaminant removal. Cleaning stage 18 rinses the foil with clean solvent which is then wiped dry by third wiper stage 20. The preferred wiper material for stages 16 and 20 is a urethane-based elastomer for its abrasion resistance, mechanical strength and surface finish and, as stated above, is preferably shaped in an H configuration to provide closely spaced twin wiper blades.

A further drying stage 22 comprises opposed heads 58 for blowing air, as indicated by arrows 60, to remove any moisture or volatile solvent.

The first and second wiper stages 12, 16, typically employ wiping pressures in the range of approximately 30–50 psi while the third wiper stage 20 typically employs a wiping pressure in the range of approximately 70–80 psi. According to a cleaning line made in accordance with the invention, stages 12, 14, 16,18 and 20 take up only approximately 24 inches in length in contradistinction to typical prior art lines of up to 100 or more feet, and as shown comprises two spray and three wiper stages. Using this line as described, a line speed of more than 300 feet/minute can be maintained while providing sufficient cleanness.

Process control is provided by an in-line optical emission sensor 62 which monitors the foil surface in response to a UV light source. The optical emission sensor 62 emits UV light on the foil and receives the optically excited electrons generated from the surface of the foil and at meter 64 provides an output signal which reflects the level of electrons generated. The fewer the surface contaminants, the more optically excited electrons are generated and thus the higher the electric current produced.

Figure 3:
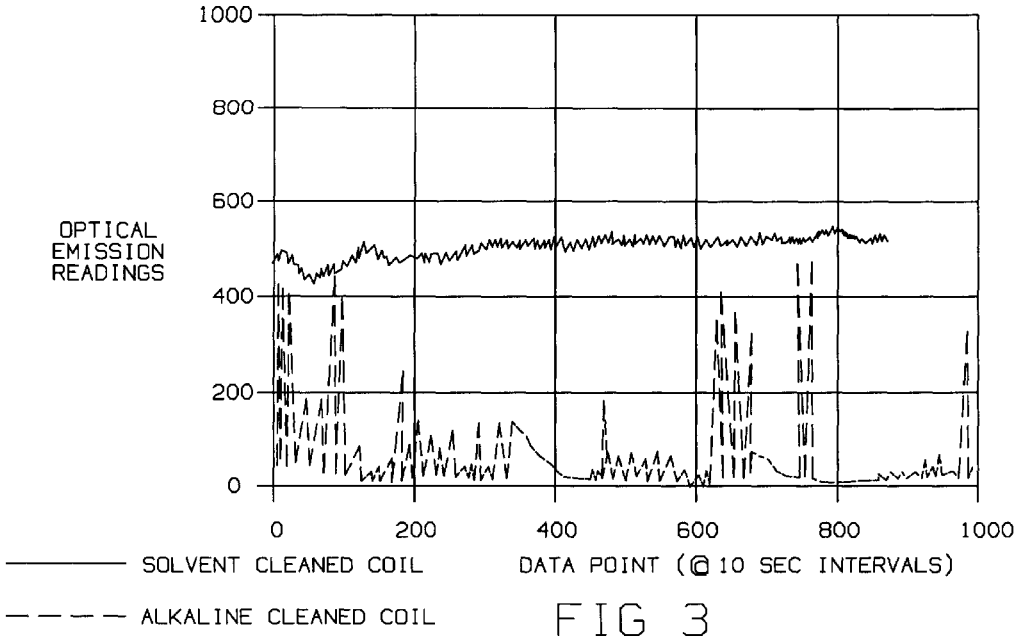
FIG. 3 is a chart showing optical sensor readings vs. data points, taken at 10 second intervals, of the surface of several coils of foil material following cleansing by a prior art alkaline method as well as by a solvent method according to the invention.
Figure 4:
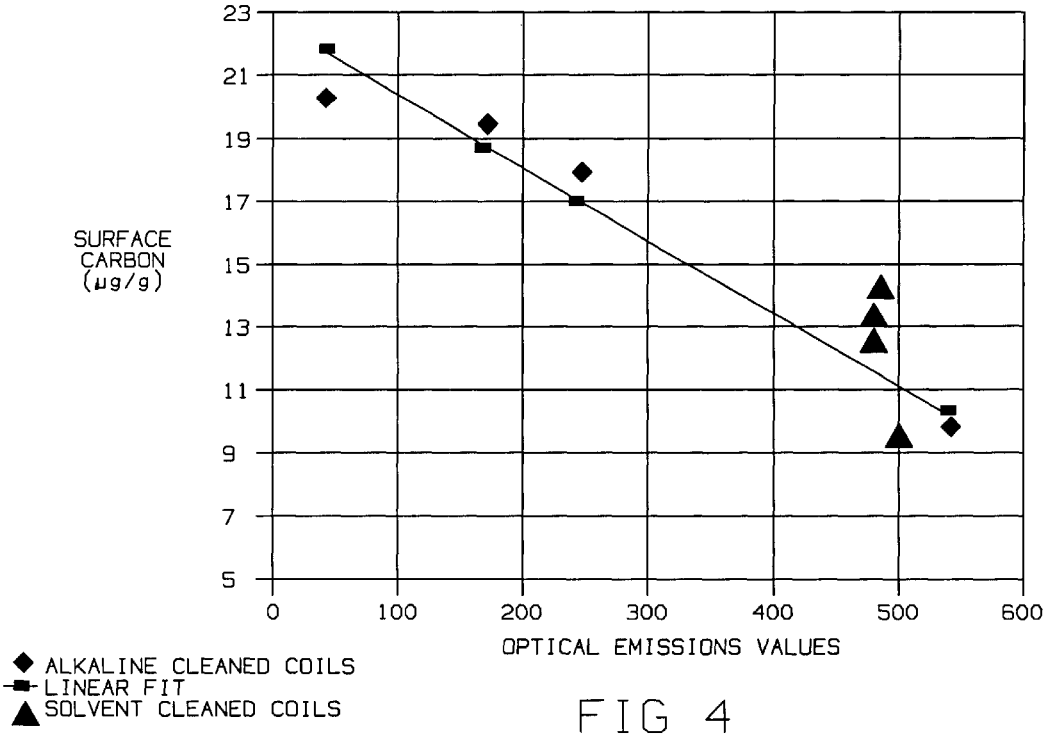
FIG. 4 is a graph of surface carbon vs. optical emission values of prior art alkaline cleaned strip material and strip material cleaned according to the solvent method of the invention.

Optical emission readings were used to illustrate the surface cleanness of coils of aluminum clad metal foils at 4 mil gauge subjected to alkaline and solvent cleaning processes. FIG. 3 shows optical sensor readings from two coils throughout their lengths. The solvent cleaned coil processed according to the invention (at a line speed of 200 feet/minute) shows significantly higher and more consistent readings than those from prior art alkaline cleaned coils (at a line speed of 100 feet/minute). The correlation of optical emission readings with residual surface carbon measurements is shown in FIG. 4. The quasi linear dependence of optical emission readings and residual carbon values provides a process control reference. It is important to note that the solvent cleaning line speed was at 200 feet/minute as compared to the 100 feet/minute of the alkaline cleaning line. Table 1 lists typical surface carbon values for samples taken from as-rolled and solvent cleaned at 200 feet/minute 2 mil stainless steel materials. The surface carbon test results show that the solvent cleaning process removed significant amounts of contaminants from the materials.

TABLE 1

Surface Carbon of 2 mil Stainless Steel Coils Subjected to Solvent Cleaning Process (at 200 feet/minute)

| Sample No. | Condition | Surface Carbon ($\mu$g/g) |
|---|---|---|
| A | as-rolled | 745 |
| B | after clean | 18 |

TABLE 1-continued

| Surface Carbon of 2 mil Stainless Steel Coils Subjected to Solvent Cleaning Process (at 200 feet/minute) | | |
|---|---|---|
| Sample No. | Condition | Surface Carbon ($\mu$g/g) |
| C | after clean | 20 |
| D | after clean | 17 |
| E | after clean | 16 |
| F | after clean | 16 |

Thus, the improved method and apparatus of the invention provides a novel and improved high speed cleaning system particularly suitable for thin gauge foil strip metal material. While the invention has been described in combination with the preferred embodiment thereof, many alternatives, modifications and variations will be apparent to those skilled in the art in light of the foregoing description. By way of example, the particular member of stations within the respective stages 12, 14, 16, 18 and 20 can be varied, as desired, as can be the material selected for the wipers. Further, the solvent composition can be varied to said particulars during requirements. Such modifications and variations can be carried out without departing from the scope of the invention which is intended to be limited only by the scope of the appended claims.

What is claimed:

1. A method for cleaning strip metal foil having opposing face surfaces comprising the steps of directing the foil along a pass-line from upstream to downstream locations, at a first wiping station biasing a pair of wipers in alignment with each other against the opposing surfaces of the foil to dislodge gross contaminants, at a first rinsing station applying laminar sheets of liquid solvent to the opposing face surfaces of the foil, and at a second wiping station biasing a pair of wipers in alignment with each other against the opposing face surfaces with at least two parallel blades of wiper material.

2. A method for cleaning strip metal foil according to claim 1 in which the liquid solvent is an aliphatic petroleum applied using a pressure of less than that which causes atomization.

3. A method for cleaning strip metal foil according to claim 2 in which the wipers of the first wiping station comprise a solid bar of polymer impregnated fiber material.

4. A method for cleaning strip metal foil according to claim 2 in which the wipers of the second wiping station comprise spaced apart blades of urethane-based elastomer material.

5. A method for cleaning strip metal foil according to claim 1, further comprising the steps of applying laminar sheets of liquid solvent to the opposing face surfaces of the foil at a second rinsing station downstream of the second wiping station, and biasing a pair of wipers in alignment with each other against the opposing face surfaces with at least two parallel blades of wiper material at a third wiping station downstream of the second rinsing station. of biasing a pair of wipers in alignment with each other against the opposing face surfaces with at least two parallel blades of wiper material.

6. A method for cleaning metal foil according to claim 5 in which approximately 30–50 psi is applied to the foil at the first and second wiper stations and approximately 70–80 psi is applied to the foil at the third wiper station. Apparatus for cleaning strip metal foil comprising a first wiping station having a pair of opposed wipers disposed on opposite sides of a pass-line, the wipers being in alignment with and movable toward and away from one another, a first rinsing station having a pair of liquid application heads disposed on opposite sides of the pass-line, and a second wiper station having a pair of opposed, wipers disposed on opposite sides of the pass-line, the wipers of the second wiping station being in alignment with and movable toward and away from one another.

7. A method according to claim 1, wherein said pair of aligned wipers at said second wiping station are biased against said opposing face surfaces to withdraw contaminated solvent therefrom.

* * * * *

UNITED STATES PATENT AND TRADEMARK OFFICE

CERTIFICATE OF CORRECTION

PATENT NO. : 6,379,468 B1
DATED : April 30, 2002
INVENTOR(S) : Chen-Chung S. Chang et al.

It is certified that error appears in the above-identified patent and that said Letters Patent is hereby corrected as shown below:

Column 6,
Lines 18-21, please delete "of biasing a pair of wipers in alignment with each other against the opposing face surfaces with at least two parallel blades of wiper material.".

Lines 25-35, please delete "Apparatus for cleaning strip metal foil comprising a first wiping station having a pair of opposed wipers disposed on opposite sides of a pass-line, the wipers being in alignment with and movable toward and away from one another, a first rinsing station having a pair of liquid application heads disposed on opposite sides of the pass-line, and a second wiper station having a pair of opposed, wipers disposed on opposite sides of the pass-line, the wipers of the second wiping station being in alignment with and movable toward and away from one another.".

Signed and Sealed this

Twenty-seventh Day of August, 2002

*Attest:*

*Attesting Officer*

JAMES E. ROGAN
*Director of the United States Patent and Trademark Office*